US007789815B2

(12) United States Patent
An

(10) Patent No.: US 7,789,815 B2
(45) Date of Patent: Sep. 7, 2010

(54) CHEST EXPANDER

(76) Inventor: Tae Jin An, 201-1307, Hana APT, 341-14, Gajung-dong, Suh-gu, Incheon-shi (KR)

( * ) Notice: Subject to any disclaimer, the term of this patent is extended or adjusted under 35 U.S.C. 154(b) by 49 days.

(21) Appl. No.: 11/786,329

(22) Filed: Apr. 11, 2007

(65) Prior Publication Data

US 2007/0238590 A1 Oct. 11, 2007

(30) Foreign Application Priority Data

Apr. 11, 2006 (KR) ..... 10-2006-0032734

(51) Int. Cl.
*A63B 23/16* (2006.01)
*A63B 21/02* (2006.01)

(52) U.S. Cl. ..... 482/126; 482/49; 482/128

(58) Field of Classification Search ..... 482/8, 482/44, 121

See application file for complete search history.

(56) References Cited

U.S. PATENT DOCUMENTS 1,444,819 A * 2/1923 Whittaker ..... 482/50
2,529,347 A * 11/1950 Ross, Jr. et al. ..... 482/126
2,806,699 A * 9/1957 Spooner ..... 482/126
2,837,334 A * 6/1958 Long ..... 482/49
3,349,621 A * 10/1967 Mullen ..... 73/379.03
3,398,746 A * 8/1968 Abramson ..... 606/147
3,515,384 A * 6/1970 Alexander ..... 482/119
3,807,729 A * 4/1974 Sigma ..... 482/49
3,937,462 A * 2/1976 Kusmer ..... 482/128
4,022,463 A * 5/1977 Scott, Jr. ..... 482/122
4,023,796 A * 5/1977 Kusmer ..... 482/126
4,149,715 A * 4/1979 Kusmer ..... 482/128
4,192,500 A * 3/1980 Crow et al. ..... 482/50
4,210,323 A * 7/1980 Feather ..... 482/131
4,262,898 A * 4/1981 Lee ..... 482/49
4,280,696 A * 7/1981 Ramon ..... 482/11
D264,737 S * 6/1982 Cooper ..... D21/684
4,332,380 A * 6/1982 Cardin ..... 482/126
4,374,588 A * 2/1983 Ruggles ..... 482/118
4,376,533 A * 3/1983 Kolbel ..... 482/125
4,433,364 A * 2/1984 Noble ..... 482/8
4,465,276 A * 8/1984 Cox ..... 482/126
4,480,832 A * 11/1984 Bulmash et al. ..... 482/113
4,483,533 A * 11/1984 Mangiapane ..... 482/122
D277,593 S * 2/1985 Terrian et al. ..... D21/693
4,513,962 A * 4/1985 Robson et al. ..... 482/49

(Continued)

*Primary Examiner*—Steve R Crow
*Assistant Examiner*—Robert F Long
(74) *Attorney, Agent, or Firm*—The Webb Law Firm

(57) ABSTRACT

Provided is a chest expander including: a head having a spring installation part at which a spring is installed and arm connection parts installed at both sides of the spring installation part; a pair of arms pivotally coupled with the arm connection parts of the head at their upper ends; a spring member vertically installed at the spring installation part of the head, and converting movement of the pair of arms approached toward each other into a resilient force generated by compressing or extending the spring to vertically transmit the resilient force to the arms; a pair of links having first ends connected to each arm and second ends extending between the arms; and a spring operation part having a link connection part connected to the second ends of the links and compressing or extending the spring member using power added and transmitted to the link connection part through the links by the movement of the arms.

5 Claims, 15 Drawing Sheets

U.S. PATENT DOCUMENTS 4,558,864 A * 12/1985 Medwedeff ..... 273/148 B
4,569,336 A * 2/1986 Wheeler ..... 601/35
4,623,141 A * 11/1986 Salvino ..... 482/49
4,629,186 A * 12/1986 Aldridge ..... 482/126
4,659,075 A * 4/1987 Wilkinson ..... 482/52
4,702,474 A * 10/1987 Guibert ..... 482/93
4,714,245 A * 12/1987 Cho ..... 482/82
4,726,580 A * 2/1988 Batiste et al. ..... 482/49
4,753,434 A * 6/1988 Salvino ..... 482/49
4,798,377 A * 1/1989 White ..... 482/49
4,861,022 A * 8/1989 Boatcallie ..... 482/126
4,869,492 A * 9/1989 Joutras ..... 482/44
4,909,506 A * 3/1990 Smith ..... 482/124
4,943,047 A * 7/1990 Noble ..... 482/49
5,022,648 A * 6/1991 Travis ..... 482/126
5,046,726 A * 9/1991 Van Straaten ..... 482/125
5,060,934 A * 10/1991 Winston ..... 482/49
D322,827 S * 12/1991 Bennstrom et al. ..... D21/684
5,072,927 A * 12/1991 Santos ..... 482/8
5,141,478 A * 8/1992 Upper ..... 482/44
5,147,256 A * 9/1992 Silagy ..... 482/47
5,180,352 A * 1/1993 Sreter ..... 482/108
5,222,926 A * 6/1993 Eggen ..... 482/49
D338,247 S * 8/1993 Koblick ..... D21/692
5,246,413 A * 9/1993 Koblick ..... 482/126
5,267,929 A * 12/1993 Chen ..... 482/128
5,297,833 A * 3/1994 Willis et al. ..... 294/102.2
5,308,299 A * 5/1994 Winston ..... 482/49
D352,754 S * 11/1994 Silagy ..... D21/684
5,399,138 A * 3/1995 Jones ..... 482/127
5,472,400 A * 12/1995 Royer ..... 482/141
5,496,245 A * 3/1996 Du Verney ..... 482/126
5,507,712 A * 4/1996 Chang ..... 482/126
5,556,003 A * 9/1996 Johnson et al. ..... 222/39
5,599,256 A * 2/1997 Hughes, Jr. ..... 482/49
5,613,927 A * 3/1997 Rothacker ..... 482/123
5,613,928 A * 3/1997 Laudone ..... 482/139
5,674,164 A * 10/1997 Kravitz ..... 482/126
5,690,596 A * 11/1997 Parker ..... 482/126
5,713,822 A * 2/1998 Newman et al. ..... 482/126
5,720,700 A * 2/1998 Buoni et al. ..... 482/124
5,743,830 A * 4/1998 Ho ..... 482/44
5,788,608 A * 8/1998 Wilkinson ..... 482/51
5,788,617 A * 8/1998 Paris ..... 482/112
5,833,580 A * 11/1998 Chiu ..... 482/49
5,913,756 A * 6/1999 Glaser ..... 482/128
D412,295 S * 7/1999 Waldvogel et al. ..... D10/85
6,042,510 A * 3/2000 Miller ..... 482/51
6,063,006 A * 5/2000 Chiu ..... 482/49
6,099,438 A * 8/2000 Dawson ..... 482/47
D431,060 S * 9/2000 Wyrick ..... D21/684
6,193,637 B1 * 2/2001 Corbin ..... 482/121
D446,561 S * 8/2001 Beard ..... D21/692
D446,832 S * 8/2001 Chen ..... D21/692
6,319,175 B1 * 11/2001 Wu ..... 482/49
6,406,406 B1 * 6/2002 Onorati ..... 482/44
6,500,103 B2 * 12/2002 Porter ..... 482/121
D470,201 S * 2/2003 Paull ..... D21/692
6,561,959 B2 * 5/2003 Batiste ..... 482/126
6,663,543 B2 * 12/2003 Wu ..... 482/126
6,672,995 B2 * 1/2004 Baltodano ..... 482/121
6,752,747 B2 * 6/2004 Yu ..... 482/110
6,786,849 B1 * 9/2004 Faulconer ..... 482/44
6,881,177 B2 * 4/2005 An ..... 482/49
D505,169 S * 5/2005 Kuo ..... D21/684
6,939,277 B2 * 9/2005 Tuller et al. ..... 482/140
D521,086 S * 5/2006 Faulconer ..... D21/684
7,115,079 B2 * 10/2006 Yu ..... 482/126
7,182,718 B2 * 2/2007 Wu ..... 482/122
7,278,954 B2 * 10/2007 Kawai et al. ..... 482/1
7,285,079 B2 * 10/2007 Mandell ..... 482/126
7,306,547 B2 * 12/2007 Stearns ..... 482/91
D561,850 S * 2/2008 Yang et al. ..... D21/684
D563,491 S * 3/2008 Kaplan et al. ..... D21/692
2002/0193212 A1 * 12/2002 Wu ..... 482/91
2004/0003687 A1 * 1/2004 An ..... 81/427
2004/0142798 A1 * 7/2004 Liao et al. ..... 482/126
2004/0171466 A1 * 9/2004 Tuller ..... 482/140
2005/0101457 A1 * 5/2005 Tuller ..... 482/128
2006/0211551 A1 * 9/2006 Mandell ..... 482/121
2007/0238590 A1 * 10/2007 Jin ..... 482/121
2008/0051271 A1 * 2/2008 Mandell ..... 482/122
2008/0076647 A1 * 3/2008 Fine ..... 482/126
2008/0103026 A1 * 5/2008 An ..... 482/49

* cited by examiner

CHEST EXPANDER

BACKGROUND OF THE INVENTION

1. Field of the Invention

The present invention relates to a chest expander.

2. Description of the Related Art

A chest expander is one of sporting goods used for exercising arms and shoulders. The chest expander is operated by gripping both grip parts formed at lower ends of a pair of arms of the chest expander, using both hands of a user. The user pushes the both arms to approach the arms toward each other, and releases the both arms to space them apart from each other, thereby exercising his/her arms, chest and shoulders. The user can repeat the above movement to increase his/her arm and shoulder muscle power.

A conventional chest expander uses a tension coil spring to use the muscle power when the user pushes the both arms to approach them together. That is, when the arms come toward each other, the coil spring is extended to apply a power in an opposite direction of the movement of the user, thereby exercising his/her muscle power.

However, when the chest expander uses the tension coil spring, a stress is concentrated on a hook part formed at a tip of the tension coil spring for connecting the arm to the tension coil spring such that the hook part can be readily broken. As a result, a reduction in durability and lifespan of the chest expander may be a major complaint of users.

In addition, since the arms of the conventional chest expander are supported by separate tension coil springs, the number of components is increased and a resilient force of the coil spring should be precisely adjusted to uniformly distribute power applied to the both arms.

SUMMARY OF THE INVENTION

The present invention provides a chest expander capable of compressing a spring installed at a head using powers added by a pair of arms to uniformly distribute a resilient force to the pair of arms using a simple structure.

The present invention also provides a chest expander capable of converting power applied to the chest expander into a vertical direction of a spring installed at a head to simplify its structure.

The present invention also provides a chest expander capable of adjusting magnitude of a resilient force.

The present invention also provides a chest expander capable with a simplified structure to increase its durability.

According to one aspect of the present invention, a chest expander includes: a head having a spring installation part at which a spring is installed and arm connection parts installed at both sides of the spring installation part; a pair of arms pivotally coupled with the arm connection parts of the head at their upper ends; a spring member vertically installed at the spring installation part of the head, and converting movement of the pair of arms approached toward each other into a resilient force generated by compressing or extending the spring to vertically transmit the resilient force to the arms; a pair of links having first ends connected to each arm and second ends extending between the arms; and a spring operation part having a link connection part connected to the second ends of the links and compressing or extending the spring member using power added and transmitted to the link connection part through the links by the movement of the arms.

In an embodiment in accordance with the present invention, the spring member may be formed of a tension coil spring or a compression coil spring, and the spring operation part may be configured to adjust magnitude of a resilient force generated by the coil spring when the arms approach each other.

In another embodiment, the spring installation part may be formed of a hollow cylindrical part having a lower open end, the coil spring may be installed inside the hollow cylindrical part, and an upper end of the coil spring may be installed at an upper surface of the hollow cylindrical part. The spring operation part may include: a support member for supporting a lower end of the coil spring; a rod support part supported by the upper surface of the hollow cylindrical part at its upper end and extending downward through a center of the coil spring; and a rod vertically inserted into a center of the rod support part, extending downward through the support member and coupled to the support member, and connected to the link connection part at its lower end. The links may be connected such that the second ends connected to the link connection part are disposed higher than the first ends of the links, and the link connection part moves upward by approach of the arms to compress the coil spring using the support member to thereby provide a resilient force. The rod may have a male threaded part formed at its outer periphery, the support member may be formed of a rotary knob fastened to the male threaded part of the rod in a threaded manner, and thus, the rod may be movable upward or downward by rotating the rotary knob in one or the other direction.

In still another embodiment, the spring installation part may be formed of a hollow cylindrical part having an upper open end, and a lower end of the coil spring is supported by a lower surface of the hollow cylindrical part. The spring operation part may include: a head part for supporting an upper end of the coil spring in a compressible manner; and a connection rod extending downward from a lower end of the head part along the hollow cylindrical part to pass through a lower surface of the hollow cylindrical part, and connected to the link connection part at its lower end. The second ends of the links connected to the link connection part may be disposed lower than the first ends of the links to move the link connection part downward when the arms approach each other so that the upper support part is moved downward by the connection rod to compress the upper end of the coil spring.

In yet another embodiment, the connection rod may include an upper rod integrally formed with the head part, and a lower rod threadedly coupled with the upper rod to adjust a coupling distance of the rod, wherein the head part and the upper rod form an adjustment screw to adjust the coupling distance between the upper and lower rods by rotating the head part and the upper rod.

Furthermore, in still another embodiment, the connection rod may extend downward through the link connection part, and may further include an adjustment screw fastened to the connection rod and disposed under the link connection part such that the link connection part moves upward and downward along the connection rod by the adjustment screw.

In a further embodiment, the spring member may include a gas spring having a rod part and a cylinder part.

In further still another embodiment, the chest expander may further include a support member for supporting the cylinder part of the gas spring and adjusting magnitude of a resilient force provided by the gas spring by lifting the cylinder part through the cylindrical part.

BRIEF DESCRIPTION OF THE DRAWINGS

These and/or other aspects and advantages of the present invention will become apparent and more readily appreciated from the following description of the embodiments, taken in conjunction with the accompanying drawings of which.

DETAILED DESCRIPTION OF THE INVENTION

Figure 1:
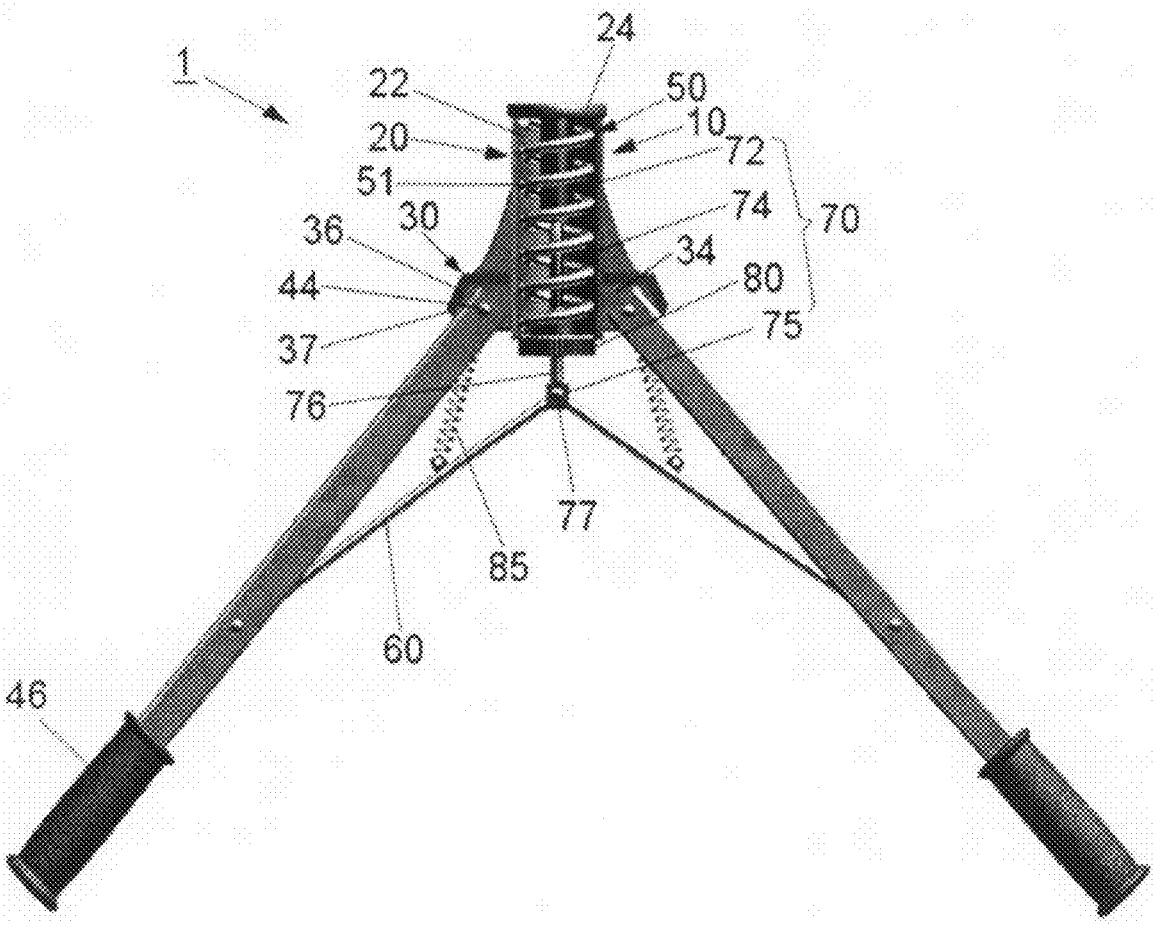
FIG. 1 is a partial cross-sectional view of a chest expander in accordance with a first exemplary embodiment of the present invention.

Reference will now be made in detail to the embodiments of the present invention, examples of which are illustrated in the accompanying drawings, wherein like reference numerals refer to like elements throughout. The embodiments are described below in order to explain the present invention by referring to the figures.

A chest expander 1 in accordance with an exemplary embodiment of the present invention includes a head 10, a pair of arms 40, a spring member 50, links 60, and a spring operation part 70.

Figure 2:
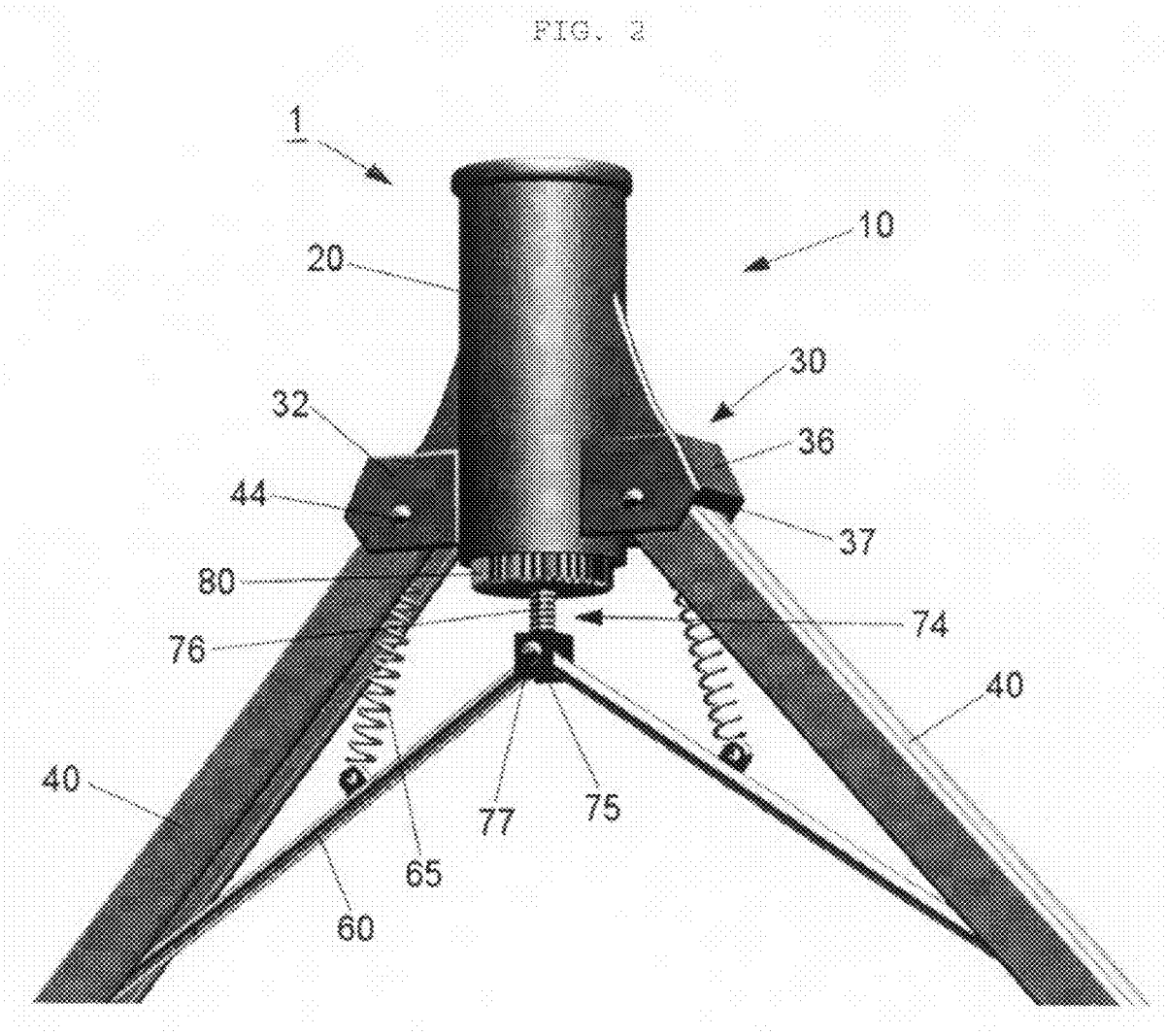
FIG. 2 is a perspective view of the chest expander in accordance with a first exemplary embodiment of the present invention.

FIG. 1 is a partial cross-sectional view of a chest expander in accordance with a first exemplary embodiment of the present invention, and FIG. 2 is a perspective view of the chest expander in accordance with a first exemplary embodiment of the present invention.

As shown in FIGS. 1 and 2, the head 10 of the chest expander 1 in accordance with the present invention includes a spring installation part 20 at which a spring is installed, and arm connection parts 30 formed at side surfaces of the spring installation part 20.

Upper parts 42 of the arms 40 are pivotally connected to the arm connection parts 30 formed at both sides of the head 10 by hinge pins 44, respectively. The arms 40 having the upper parts 42 pivotally connected to the arm connection parts 30 extend downward and have grip parts 46 formed at their lower ends and gripped by a user. The grip part 46 is generally formed of an anti-slide pad made of a rubber material to prevent a user's hands from slipping. In addition, the grip parts 46 may have finger-shaped gripping grooves (not shown) in which a user's fingers can be readily positioned.

The upper parts 43 of the arms 40 are inserted into the arm connection parts 30 to be rotatably fixed by the hinge pins 44 passing through front and rear sidewalls 32 and 34 and fastened thereto. The maximum open angle of the arms 40 are limited by lower ends 37 of outer sidewalls 36 of the arm connection parts 30 disposed at both sides of the head 10.

The spring installation part 20 of the head 10 has a hollow cylindrical part 22 having a lower open end and vertically extending downward from the spring installation part 20 to accommodate a coil spring 51 as the spring member 50. An upper end of the coil spring 51 installed in the hollow cylindrical part 22 is supported by an upper surface 24 of the hollow cylindrical part 22, and a lower end of the coil spring 51 is supported by a disc-shaped rotary knob 80.

In accordance with the first exemplary embodiment of the present invention, the spring member 50 is the coil spring 51, a force required to approach the arms 40 toward each other corresponds to a resilient force generated when the coil spring 51 is compressed. The coil spring 51 is compressed or recovered as the rotary knob 80 supporting the lower end of the coil spring 51 moves upward or downward depending on movement of the arms 40.

In accordance with the first exemplary embodiment of the present invention, the spring operation part 70 for receiving movement of the arms 40 and compressing the coil spring 51 includes a rod support part 72, a rod 74, and the rotary knob 80 as a support member fixed to the rod 74 and supporting the lower end of the coil spring 51.

The rod support part 72 is fixed to the upper surface 24 of the hollow cylindrical part 22 at its upper end and extends downward from inside the hollow cylindrical part 22 through the center of the coil spring 51. In addition, the rod 74 is inserted into a center hollow part of the rod support part 72 to be movably supported in a vertical direction. The rod 74 extends downward from inside the rod support part 72 to the exterior of the hollow cylindrical part 22, and is connected to the link connection part 75 at its lower end. The rotary knob 80 as a disc shaped support member is installed at the rod 74 to support the lower end of the coil spring 51. Therefore, when the link connection part 75 moves upward, the rod 74 is guided by the center hollow part of the rod support part 72 to move upward, and the rotary knob 80 supported by the rod 74 is lifted to compress the coil spring 51 supported by the knob 80 upward. As a result, the coil spring 51 provides a resilient force to the arms 40 corresponding to the compression displacement.

Links 60 are connected between the arms 40 and the link connection part 75. The links 60 extend between the arms 40, and have first ends pivotally connected to the arms 40 and second ends pivotally connected to the link connection parts 75 by a fixing pin 77, respectively. The first ends of the links 60 connected to the arms 40 are disposed lower than the second ends of the links 60 connected to the link connection part 74. Therefore, when the arms 40 approach each other, the link connection part 75 moves upward. Relatively weak tension springs 65 are installed between the links 60 and the arms 40 to resiliently support the links 60 and the arms 40.

Figure 3:
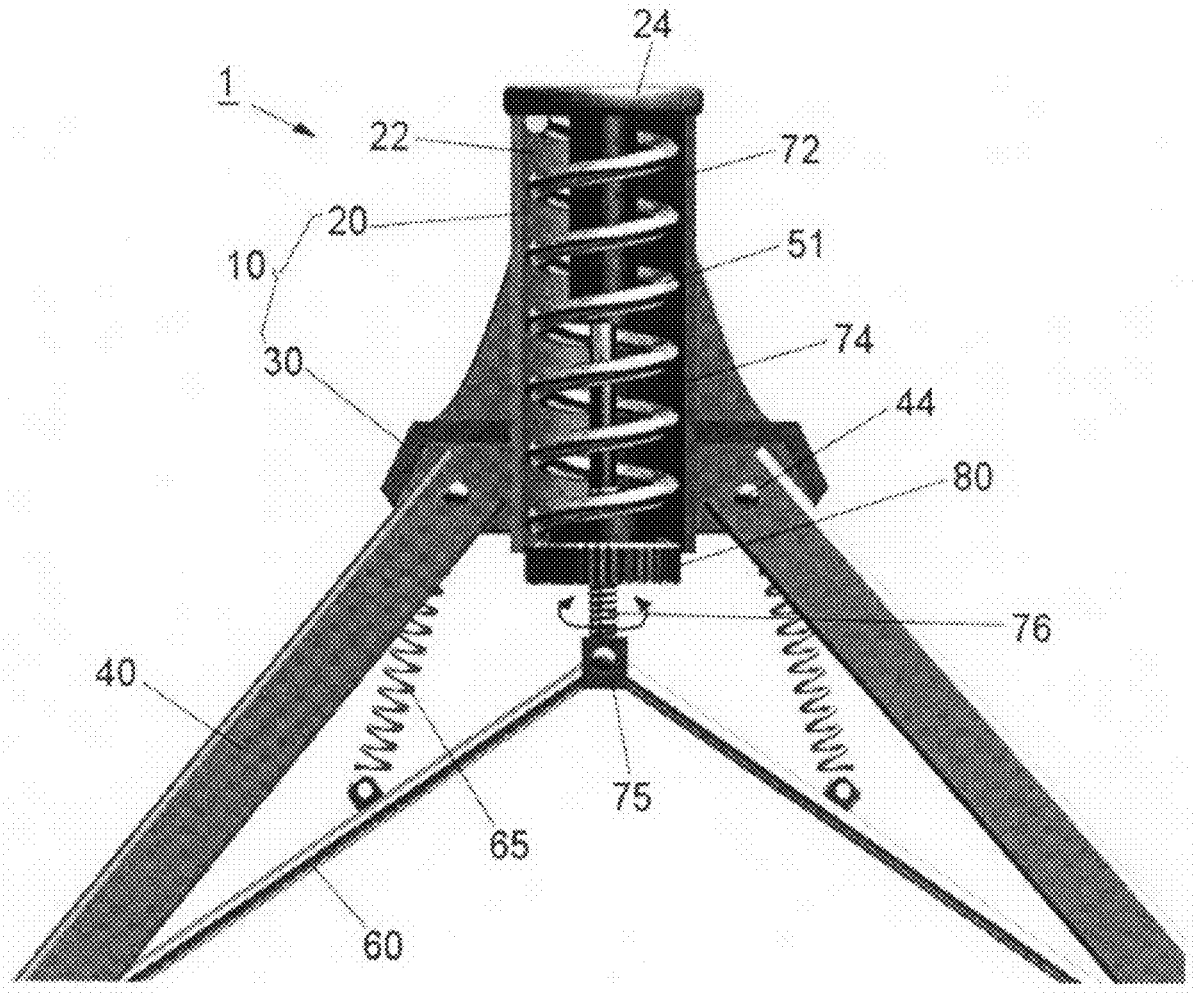
FIG. 3 is a cross-sectional view illustrating strength adjustment of the chest expander in accordance with a first exemplary embodiment of the present invention.
Figure 4:
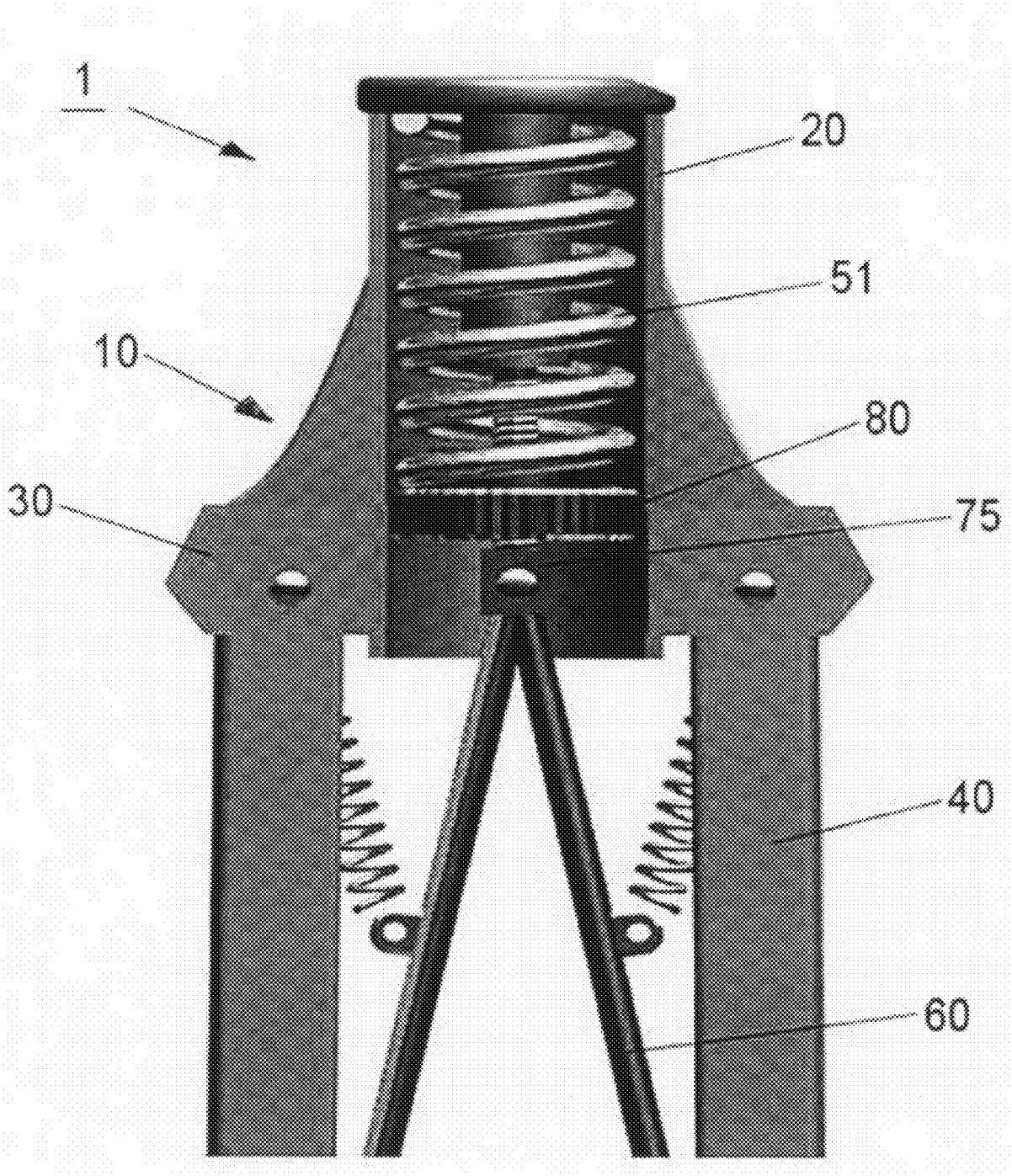
FIG. 4 is a cross-sectional view of the chest expander in accordance with a first exemplary embodiment of the present invention, a resilient force of which is adjusted in a relatively weak state.
Figure 5:
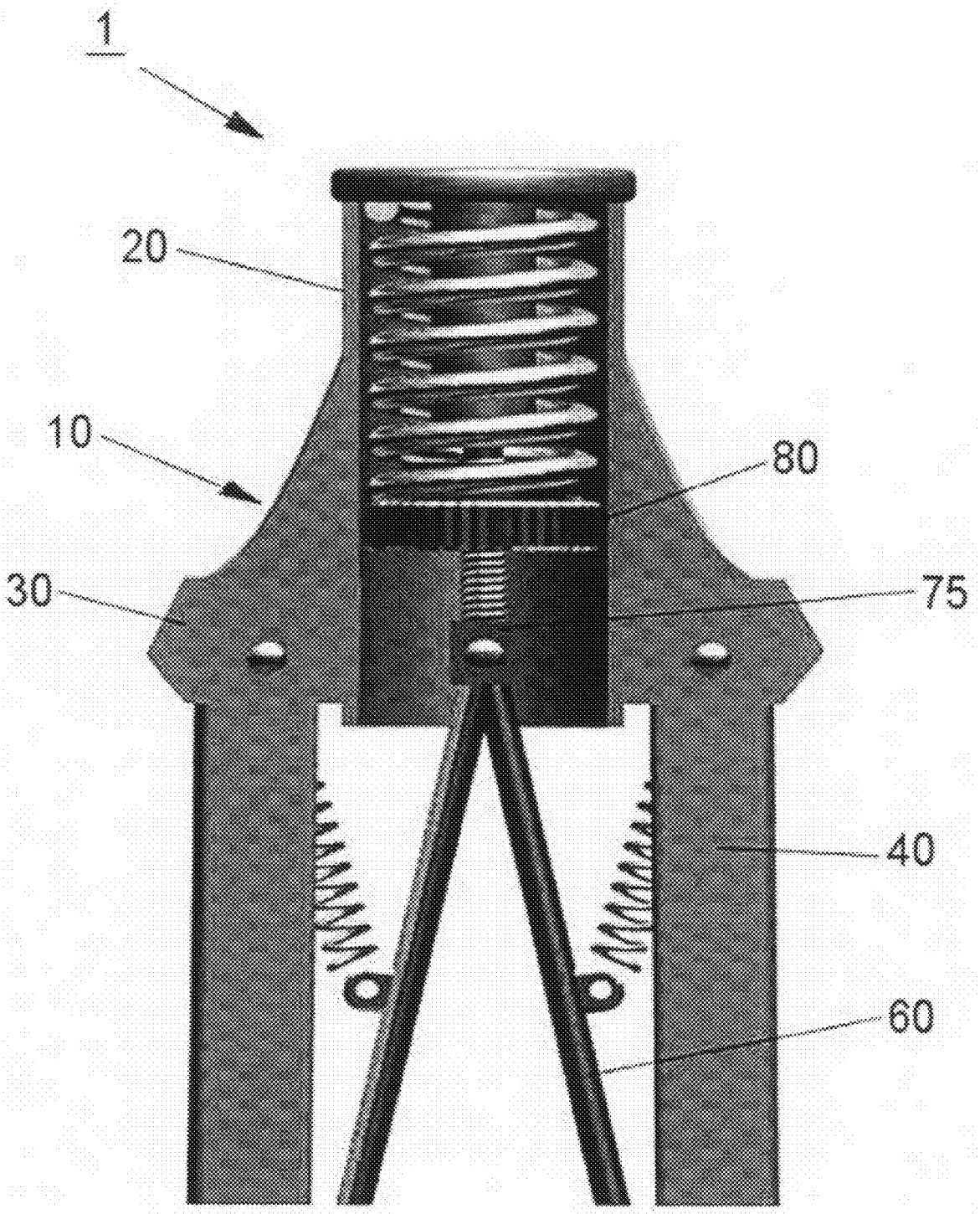
FIG. 5 is a cross-sectional view of the chest expander in accordance with a first exemplary embodiment of the present invention, a resilient force of which is adjusted in a relatively strong state.

The chest expander 1 in accordance with the first exemplary embodiment of the present invention is configured to adjust a force for pushing the arms 40, i.e., strength of the chest expander 1. The rod 74 has a male threaded part 76 formed at its outer periphery. The rotary knob 80 has a threaded hole formed at its center and fastened to the male threaded part 76 of the rod 74. The rod 74 is threadedly engaged with the rotary knob 80, and rotation of the rotary knob 80 is converted into vertical movement of the rod 74. As shown in FIG. 3, the disc shaped rotary knob 80 can be rotated in one or the other direction, and rotation in one direction of the rotary knob 80 moves the rod 74 downward to make the arms 40 be spaced apart from each other. Therefore, when the arms 40 maximally approach each other, the coil spring has a maximum relative displacement (see FIG. 5) such that a large muscle power is required. When the rotary knob 80 is rotated in the other direction, the rod 74 moves upward to narrow a distance between the arms 40. Therefore, when the arms 40 maximally approach each other, displacement of the coil spring 51 is relatively reduced (see FIG. 4). As a result, a power required for maximally approaching the arms 40, i.e., the power for exercise, is reduced. That is, manipulation of the rotary knob 80 shown in FIG. 3 enables to adjust magnitude of a resilient force, i.e., strength of the chest expander 1 as shown in FIG. 4 or 5. Therefore, it is possible for a user to adjust the strength of the chest expander, appropriate to the user, using the rotary knob 80.

Figure 6:
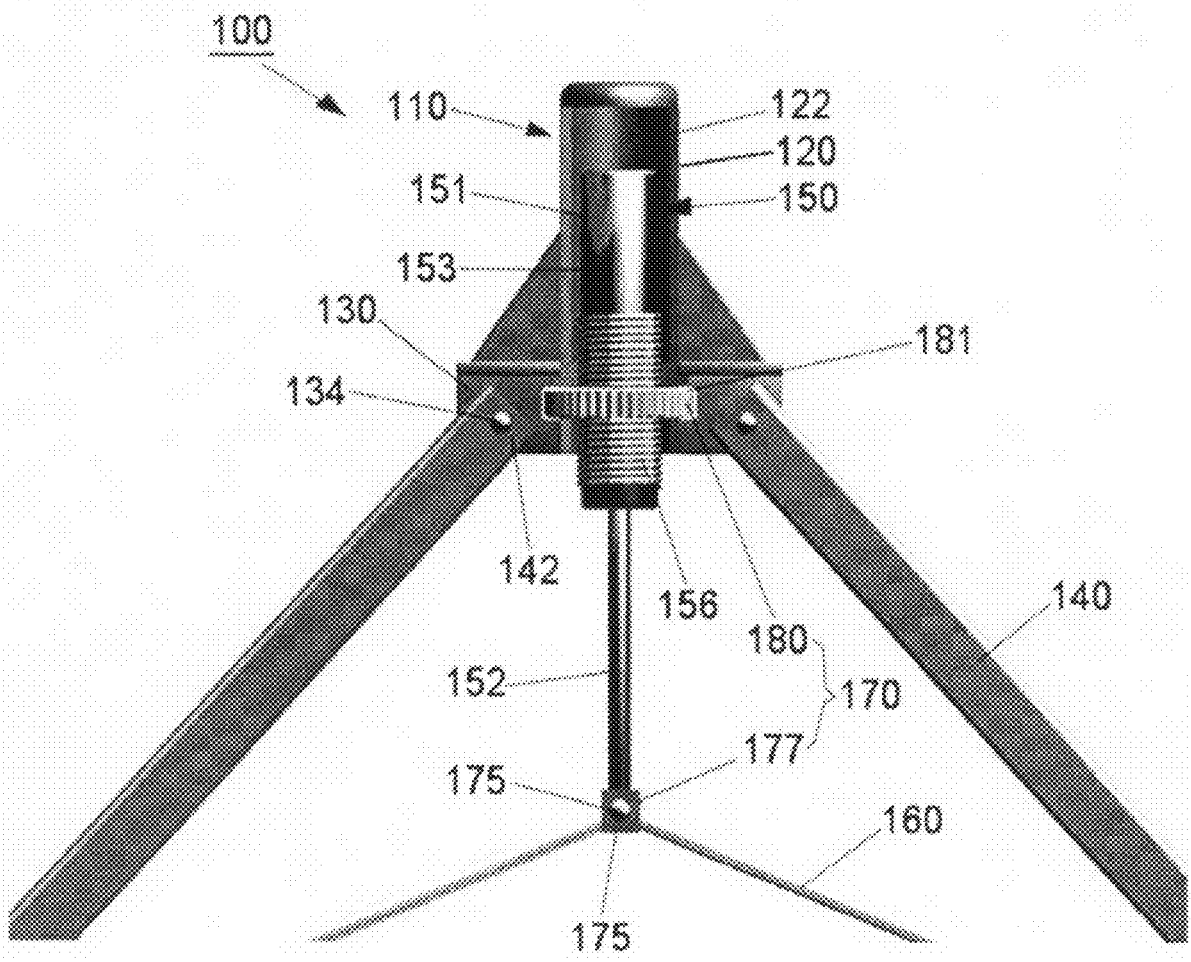
FIG. 6 is a partial cross-sectional view of a chest expander in accordance with a second exemplary embodiment of the present invention.
Figure 7:
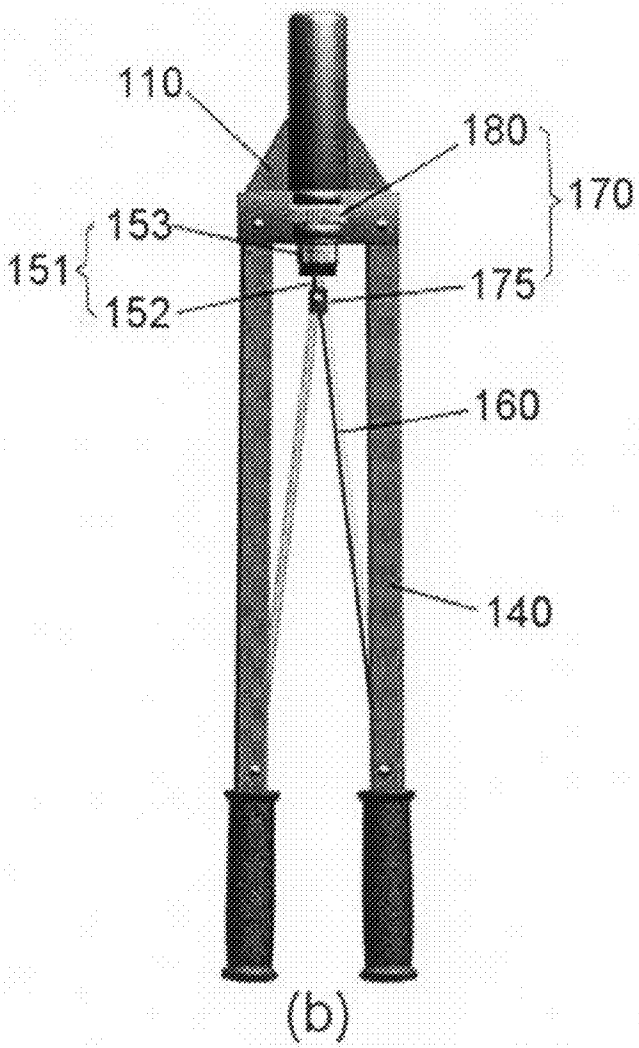
FIGS. 7A, 7B, 8A and 8B are perspective views showing appearances and operated states of the chest expander in accordance with a second exemplary embodiment of the present invention.
Figure 7:
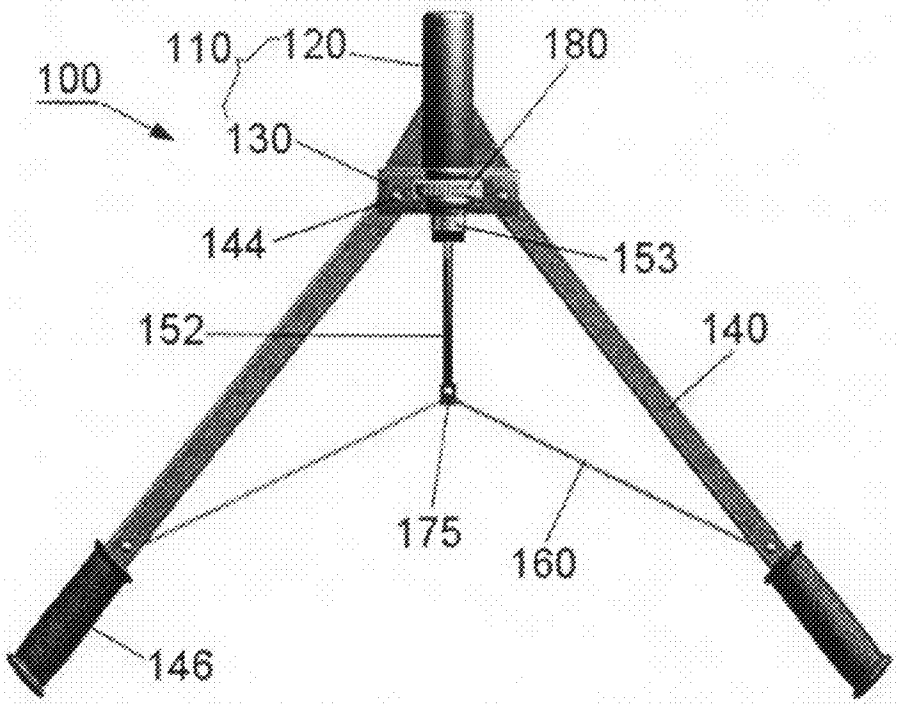
Figure 8:
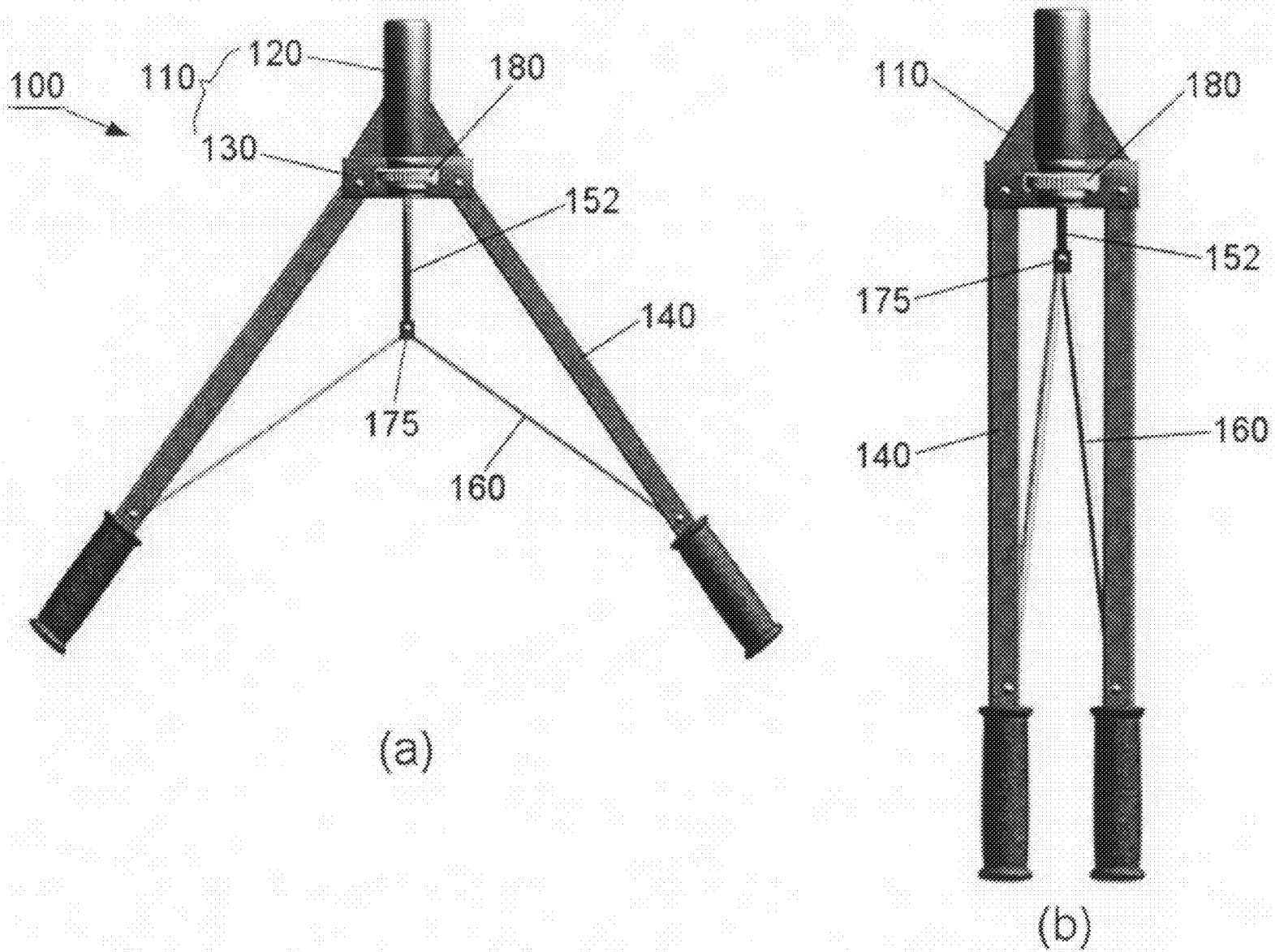

FIG. 6 is a partial cross-sectional view of a chest expander 100 in accordance with a second exemplary embodiment of the present invention, and FIGS. 7A and 8A, and 7B and 8B are perspective views showing appearances and operated states of the chest expander 100 in accordance with a second exemplary embodiment of the present invention. In accordance with the second exemplary embodiment of the present invention, a head 110 of the chest expander 100 includes a spring installation part 120 at which a spring is installed, and arm connection parts 130 formed at sides of the spring installation part 120.

Upper parts 142 of the arms 140 are pivotally connected to the arm connection parts 130 disposed at both sides of the head 110 by hinge pins 144, respectively. The arms 140 include grip parts formed at their lower ends, similar to the first embodiment shown in FIGS. 1 and 2.

The spring installation part 120 of the head 110 is formed of a hollow cylindrical part 122 having a lower open end and vertically extending therefrom to accommodate a gas spring 151 as a spring member 150. In accordance with the second exemplary embodiment of the present invention, the spring member 150 is formed of a compression gas spring 151. The gas spring 151 includes a rod part 152, and a cylinder part 153. The rod part 152 is connected to a piston (not shown) disposed in the cylinder part 153 to extend to the exterior of the cylinder part 152. Therefore, the gas spring 151 provides a resilient force to push the rod part 152 downward corresponding to a compression distance in which the rod part 152 moved into the cylinder part 153. As a result, when the user pushes the arms 40 to approach them toward each other, the rod part 152 moves into the cylinder part 153, and the gas spring 151 provides a resilient force in a direction opposite thereto.

In accordance with the second exemplary embodiment of the present invention, the spring operation part 170 for receiving movement of the arms 150 and compressing the gas spring 150 includes a rotary knob 180 for supporting the cylinder part 153 of the gas spring 151 with respect to the hollow cylindrical part 122, and a link connection part 175 formed at a lower end of the rod part 152. Links 160 extending from the arms 140 and disposed at both sides of the link connection part 175 are pivotally fixed to the link connection part 175 by a fixing pin 177.

The rotary knob 180 is installed in a cylindrical groove 181 having a larger diameter than a center hole of the hollow cylindrical part 122 and formed in a longitudinal direction thereof. The rotary knob 180 is supported by the cylindrical groove 181 to support the cylinder part 153. For this purpose, the cylindrical part 153 has a male threaded part 156 formed at its outer periphery, and the rotary knob 180 has a screw hole, i.e., a female threaded part fastened to the male threaded part, thereby threadedly engaging the cylinder part 153 with the rotary knob 180. Therefore, when the rotary knob 180 is rotated in one direction or the other direction, the cylinder part 153 of the gas spring 151 can move upward or downward.

Meanwhile, links 160 are installed between the arms 140 and the link connection part 175 to convert approach movement of the arms 140 into upward movement of the link connection part 175. At this time, first ends of the links 160 connected to the arms 140 are disposed lower than second ends of the links 160 connected to the link connection part 175 such that the approach movement of the arms 140 is converted into the upward movement of the link connection part 175.

Hereinafter, operation of the chest expander 100 in accordance with the second exemplary embodiment of the present invention will be described with reference to FIGS. 7A and 8A, and 7B and 8B.

First, comparing FIG. 7A with FIG. 8A, it will be appreciated that the cylinder part 153 of the gas spring 151 (see FIG. 7A) is relatively higher than that of FIG. 8A by adjusting the rotary knob 180. Since the rotary knob 180 is supported by the cylindrical groove 181 to support the cylinder part 153, one or the other direction rotation of the rotary knob 180 causes the cylinder part 153 to be raised or lowered.

Referring to FIG. 7A, the rotary knob 180 is rotated in one direction, and the cylinder part 153 is relatively lowered from inside the hollow cylindrical part 122 to the exterior. Therefore, as shown in FIG. 7B, when a user pushes the arms 140 to approach them toward each other, a length of the rod part 152 inserted into the cylinder part 153 is relatively large. That is, a length of the rod part 152 exposed to the exterior of the cylinder part 153 is small.

However, referring to FIG. 8A, the rotary knob 180 is rotated in the other direction, and the cylinder part 153 is relatively raised inside the hollow cylinder part 122. In this case, as shown in FIG. 8B, when a user pushes the arms 140 to approach them toward each other, since the cylinder part 153 was relatively raised, a length of the rod part 152 inserted into the cylinder part 153 is relatively small. That is, a length of the rod part 152 exposed to the exterior of the cylinder part 153 is relatively large. Comparing FIG. 7B with FIG. 8B, when a user pushes the arms 140 to approach them toward each other, the link connection part 175 is raised to the same position by movement of the arms 140. However, since vertical positions of the cylinder part 153 are different, in the case of FIG. 7, the arms 140 approach each other in a state that the cylinder part 153 is relatively lowered so that a compression displacement of the gas spring 151 is relatively lengthened. This means that a position of the cylinder part 153 can be vertically adjusted to adjust magnitude of a resilient force provided through compression of the gas spring 151 by rotating the rotary knob 180. Therefore, manipulation of the rotary knob 180 enables adjustment of the magnitude of the resilient force provided by the gas spring 151 to adjust strength of the chest expander 100.

Figure 9:
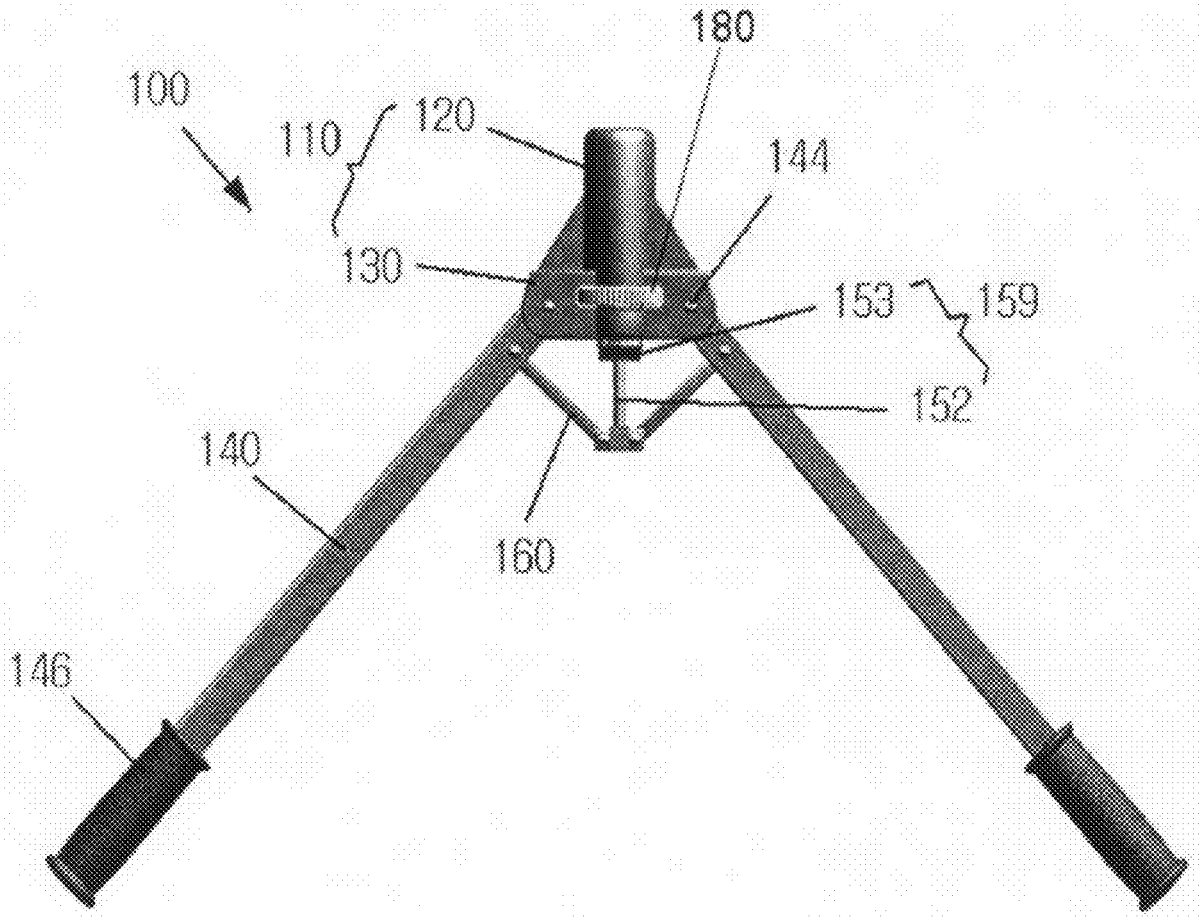
FIG. 9 is a perspective view of a chest expander in accordance with a third exemplary embodiment of the present invention.

FIG. 9 is a perspective view of a chest expander 100 in accordance with a third exemplary embodiment of the present invention. Comparing the third embodiment with the second embodiment shown in FIGS. 6 to 8, the spring member 150 is changed into a tension gas spring 159 from the compression gas spring. That is, when the rod part 152 is pulled outside the cylinder part 153, the spring member 150 provides a resilient force to pull the rod part 152 inside the cylinder part 153.

In addition, the links 160 of the third embodiment has a connection structure, different from the second embodiment. One of ends of the links 160 connected to the arms 140 is disposed higher than other ends of the links 160 connected to the link connection parts 175. Therefore, approach movement of the arms 140 is converted into lowering movement of the link connection part 175. The lowering movement of the link connection part 175 causes pulling of the rod part 152, and at this time, the gas spring 151 applies a resilient force in a direction opposite to the pulling direction of the rod part 152.

Similar to the second embodiment, it is also possible to adjust strength of the chest expander 100 by adjusting a rotary knob 180. However, when the cylinder part 153 is lowered, the magnitude of the resilient force is relatively lowered, and when the cylinder part 153 is raised, the magnitude of the resilient force is relatively increased. That is, moving directions of the cylinder part 153 of the third embodiment are reversed, in comparison with the second embodiment.

Figure 10:
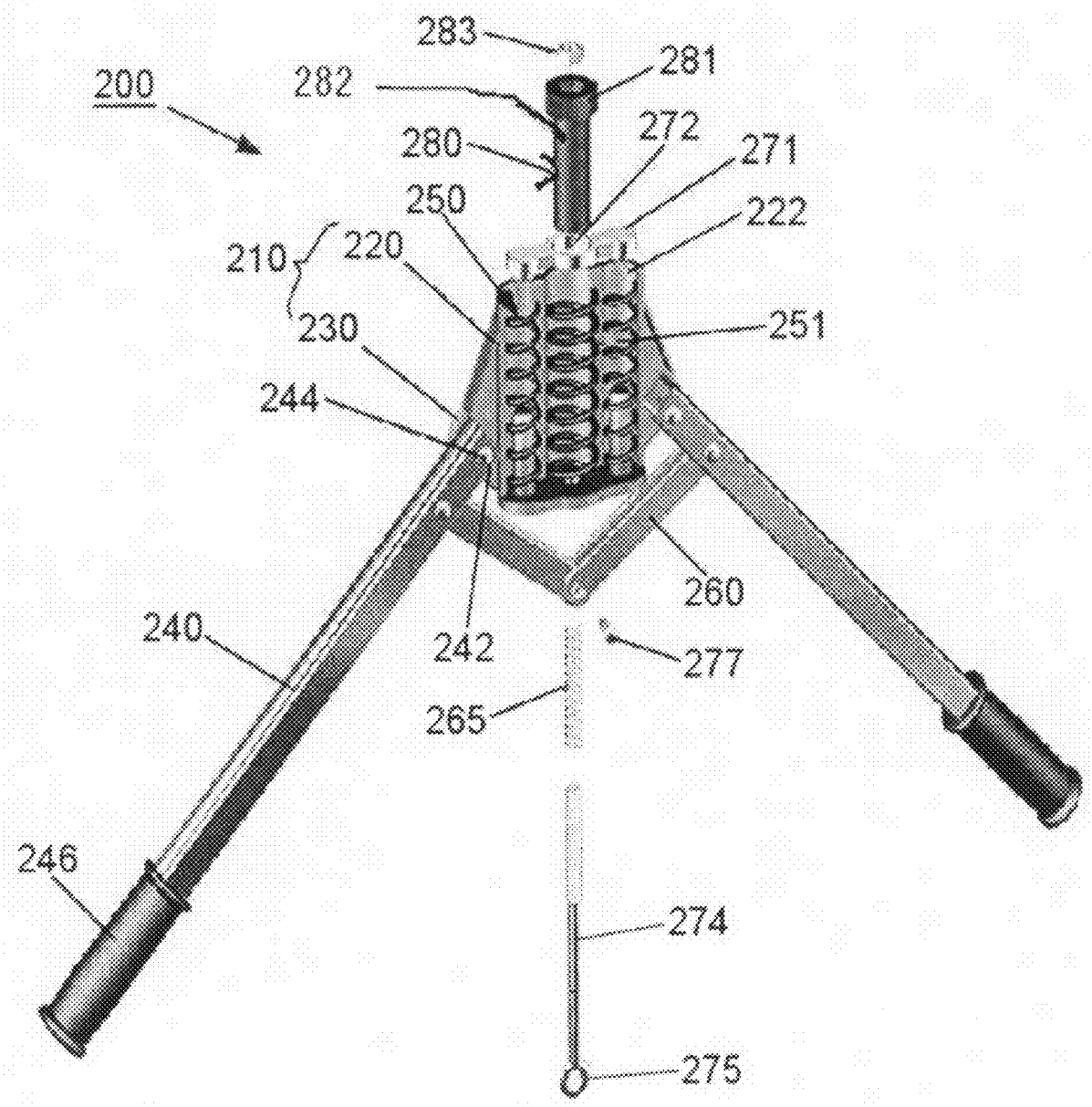
FIG. 10 is a partially exploded cross-sectional view of a chest expander in accordance with a fourth exemplary embodiment of the present invention.
Figure 11:
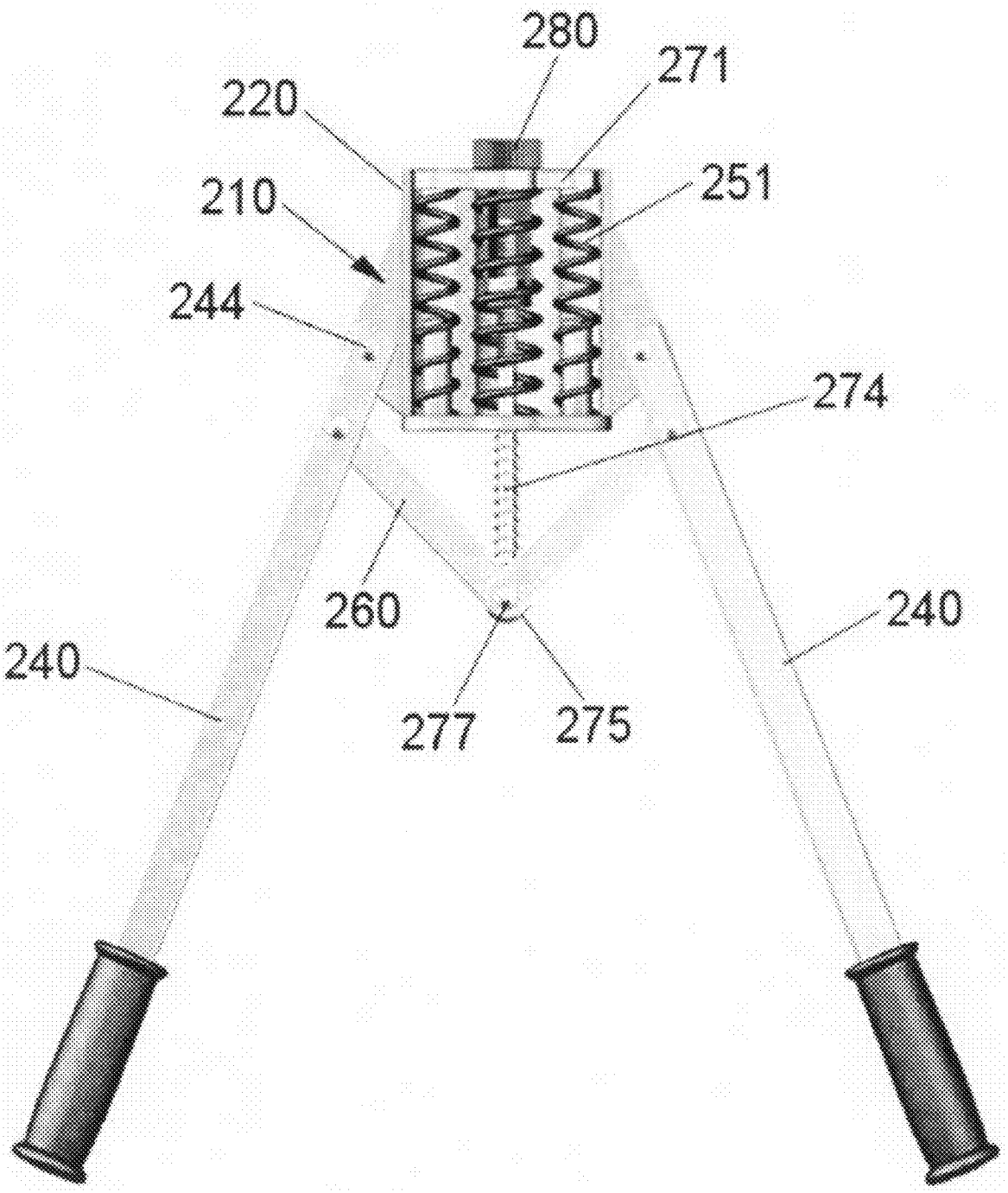
FIG. 11 is a partially assembled cross-sectional view of the chest expander in accordance with a fourth exemplary embodiment of the present invention.
Figure 12:
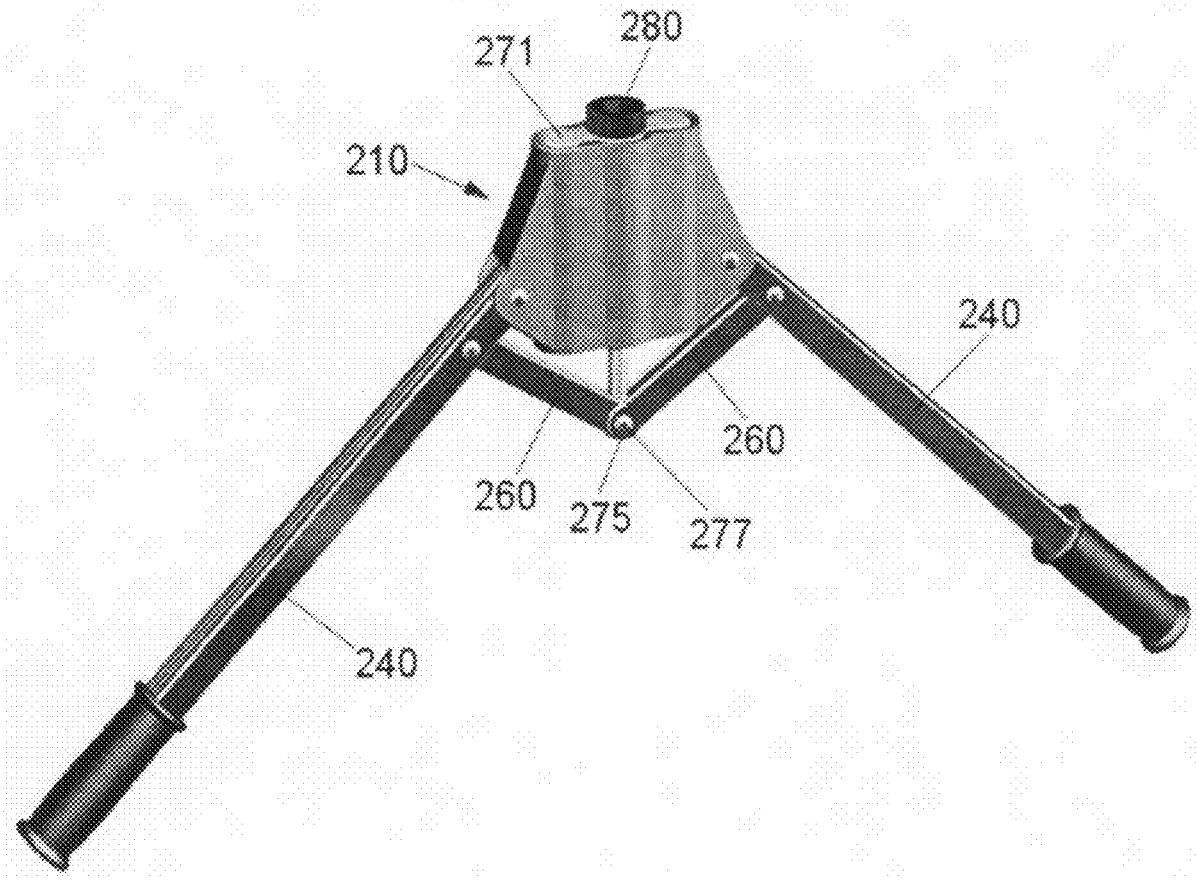
FIG. 12 is a perspective view of the chest expander in accordance with a fourth exemplary embodiment of the present invention.
Figure 13:
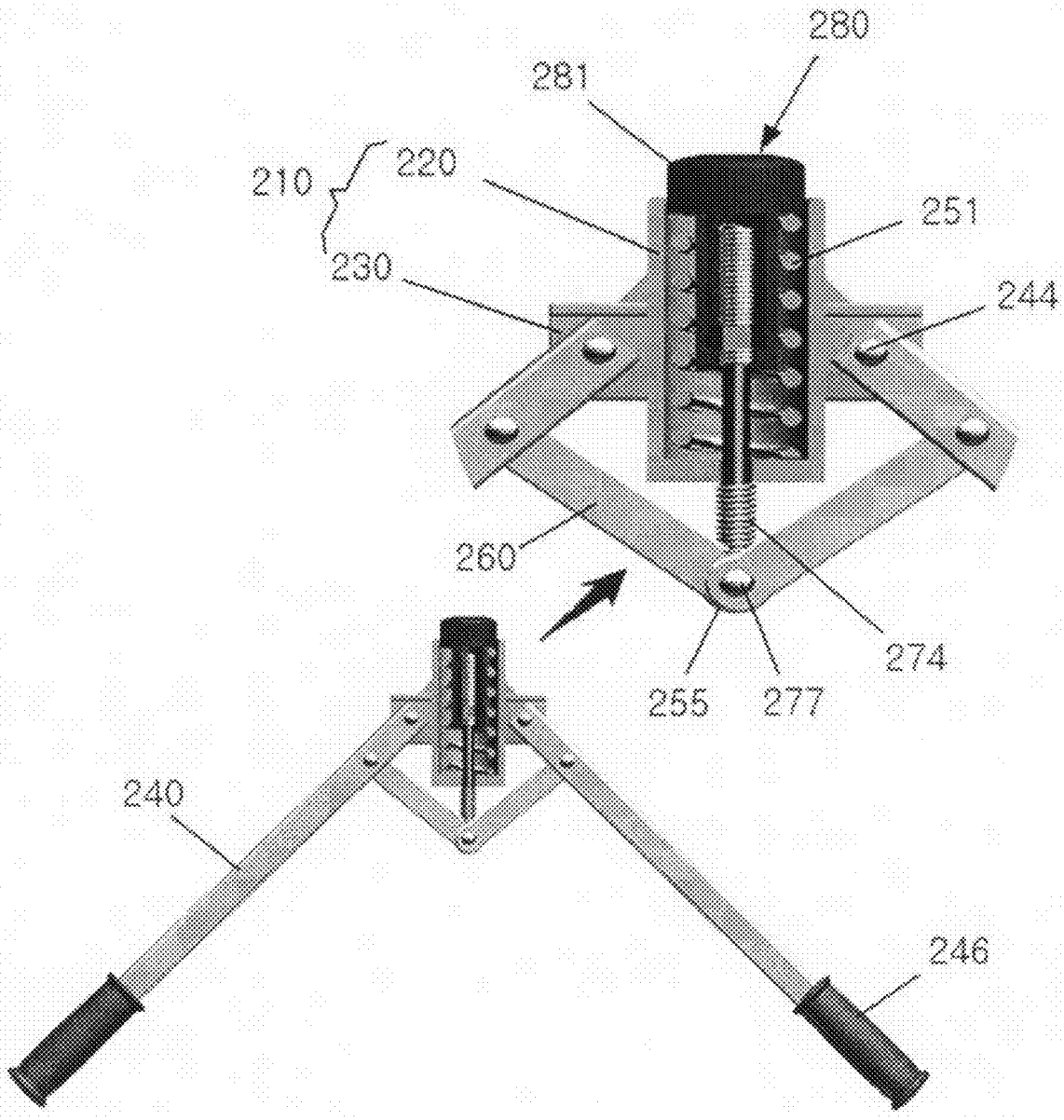
FIG. 13 is a partially exploded cross-sectional view of modification of the chest expander in accordance with a fourth exemplary embodiment of the present invention.
Figure 14:
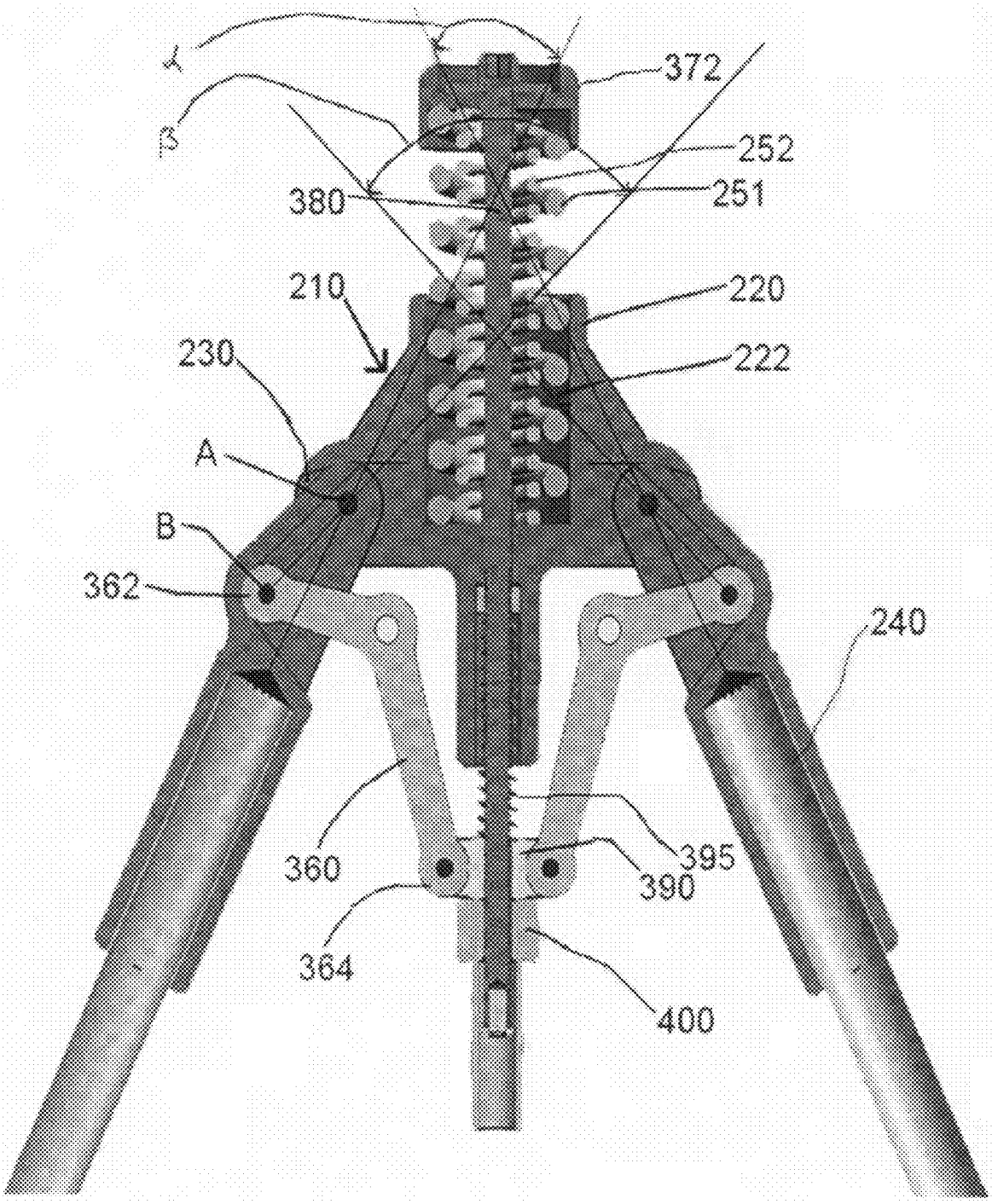
FIG. 14 is a partial cross-sectional view of another modification of the chest expander in accordance with a fourth exemplary embodiment of the present invention.

FIG. 10 is a partially exploded cross-sectional view of a chest expander in accordance with a fourth exemplary embodiment of the present invention, FIG. 11 is a partially assembled cross-sectional view of the chest expander in accordance with a fourth exemplary embodiment of the present invention, FIG. 12 is a perspective view of the chest expander in accordance with a fourth exemplary embodiment of the present invention, and FIGS. 13 and 14 are partially exploded cross-sectional views of modifications of the chest expander in accordance with a fourth exemplary embodiment of the present invention.

Referring to FIGS. 10 to 12, a head 210 of a chest expander 200 in accordance with a fourth exemplary embodiment of the present invention includes a spring installation part 220 at which a spring is installed, and arm connection parts 230 formed at both sides of the spring installation part 220.

Upper ends 242 of the arms 240 are pivotally connected to the arm connection parts 230 formed at both sides of the head 210 by hinge pins 244. Similar to the first embodiment shown in FIGS. 1 and 2, the arms 240 have grip parts 246 formed at their lower ends.

The spring installation part 220 of the head 210 is formed of a hollow cylindrical part 222 extending in a vertical direction and having a closed lower surface, and a spring member 250 is a compression coil spring 251 supported by the lower surface of the hollow cylindrical part 222. As shown in FIGS. 10 and 11, the hollow cylindrical part 222 may have a plurality of hollow cylindrical sections in communication with each other in parallel to accommodate a plurality of coil springs 251. However, as shown in FIG. 13 illustrating modification of the fourth embodiment, a spring installation part formed of a single hollow cylindrical part is provided to constitute a chest expander. The modified chest expander of the fourth embodiment shown in FIG. 13 is the same as the fourth embodiment shown in FIGS. 10 to 12, except that the single hollow cylindrical part is provided. A head part 281 directly supports an upper end of a coil spring.

Referring again to FIGS. 10 to 12 showing the fourth embodiment, a spring operation part for receiving movement of the arms 240 and compressing the coil spring 251 includes a connection rod having a head part 281 and a link connection part disposed under the head part, may include a pressing piece 271.

The compression spring 250 is installed in the hollow cylindrical part 222 constituting the spring installation part 220. In the fourth embodiment, the compression spring 250 includes a plurality of coil springs 251.

Upper ends of the plurality of coil springs 251 are supported by the pressing piece 271. As the pressing piece 271 moves upward and downward in a longitudinal direction of the hollow cylindrical part 222, the coil springs 251 are compressed or recovered.

The head part 281 is supported by an upper surface of the pressing piece 271 to receive a force pulled by the connection rod connected to the head part 281, thereby lowering the pressing piece 271.

The connection rod extending downward from a lower end of the head part 281 to pass through a through-hole 272 of the pressing piece 271 extends downward to pass through a lower surface of the hollow cylindrical part 222, and has a link connection part 275 formed at its lower end. In accordance with the fourth exemplary embodiment of the present invention, the connection rod includes an upper rod 282 integrally formed with the head part 281, and a lower rod 274 threadedly engaged with the upper rod 282 to adjust a fastening length thereof. In accordance with the fourth exemplary embodiment of the present invention, the head part 281 and the upper rod 282 may be integrally formed or separately formed to constitute an adjustment screw 280. Hereinafter, the adjustment screw 280 and the lower rod 274 fastened to the adjustment screw 280 will be described as the fourth embodiment of the present invention.

The adjustment screw 280 is formed as a hollow type. The lower rod 274 is inserted into a hollow part, i.e., a center hole of the adjustment screw 280. A nut 283 having a female threaded part formed at its inner periphery is inserted into the center hole, and therefore, the lower rod is threadedly engaged with the upper rod 282 of the adjustment screw 289 through the medium of the nut 283. When the center hole has a female threaded part formed at its inner periphery, the nut 283 may be omitted.

The link connection part 275 formed at the lower end of the lower rod 274 has a ring shape. Second ends of links 260 are pivotally connected to the link connection part 275 by a fixing pin 277. A relatively weak spring 265 is installed between the link connection part 275 of the lower rod 274 and the lower end of the hollow cylindrical part 222.

First ends of the links 260 are coupled with the arms 240, and the second ends are coupled with the link connection part 275 by the fixing pin 277. The first ends of the links 260 are disposed higher than the second ends such that the links 260 extend downward from the first ends toward the second ends fixed to the link connection part 275.

Figure 15:
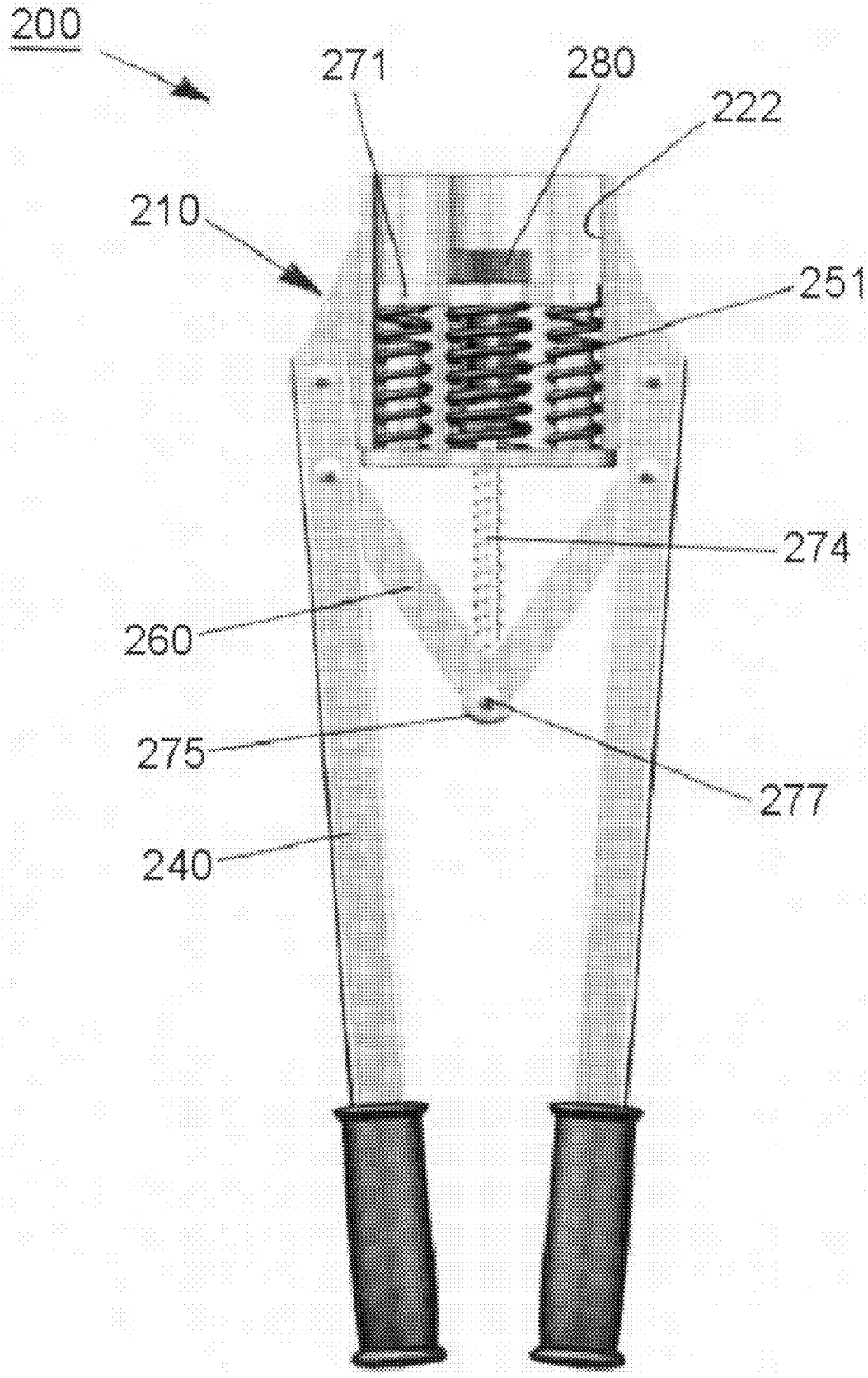
FIG. 15 is a partial cross-sectional view showing an operated state of the chest expander in accordance with a fourth exemplary embodiment of the present invention.

Referring to FIG. 15 showing operation of the chest expander 200 in accordance with a fourth exemplary embodiment of the present invention, when a user pushes the arms 240 to approach them toward each other, the approach of the arms 240 causes lowering movement of the second ends of the links 260 and the link connection part 275 connected thereto. Since the lower rod 274 having the link connection part 275 is coupled with the adjustment screw 280, the lowering movement of the link connection part 275 pulls the lower rod 274 and the head part 281 of the adjustment screw 280 coupled with the lower rod 274 downward. As a result, the head part 281 of the adjustment screw 280 pulls the pressing piece 271 downward to compress the coil spring 251. That is, the approach of the arms 240 is converted into the lowering movement of the pressing piece 271 pressing the upper end of the coil spring 251 to compress the coil spring 251, thereby providing a resilient force to the chest expander 300.

In accordance with the fourth exemplary embodiment of the present invention, since the adjustment screw 280 is threadedly engaged with the lower rod 274, when the head part 281 of the adjustment screw 280 is rotated in one or the other direction, it is possible to adjust a fastening length of the adjustment screw 280 and the lower rod 274, more specifically, a fastening length of the upper rod 282 and the lower rod 274. Therefore, it is possible to adjust a length of the connection rod.

The one direction rotation of the adjustment screw 280 shortens the fastening length to move the lower rod 274 downward, and the other direction of the adjustment screw 280 lengthens the fastening length to move the lower rod 274 upward. When the lower rod 274 moves downward, a distance between the arms 240 is shortened, and displacement of the coil spring 251 is relatively shortened in a state that the arms 240 are closed to each other. On the other hand, when the lower rod 274 moves upward, a distance between the arms 240 is lengthened, and displacement of the coil spring 251 is relatively lengthened in a state that the arms 240 are closed to each other. Since a force to approach the arms 240 is in proportion to the displacement of the coil spring 251, it is possible to adjust strength of the chest expander 200 by rotating the adjustment screw 280.

FIG. 14 is a view of another modification of a fourth embodiment in accordance with the present invention. The other modification shown in FIG. 14 has different constitution of a spring operation part 370 from the fourth embodiment of the present invention.

Referring to FIG. 14, the spring operation part 370 includes a head part 372 for supporting an upper end of a coil spring 251 installed at a spring installation part formed of a hollow cylindrical part 222, a connection rod 380, and a link connection part 390.

The connection rod 380 is fixed to the head part 372 at its upper end to extend downward through a center of the coil spring 251 to pass through a lower end of the hollow cylindrical part 222 and below the head 210.

The link connection part 390 is coupled with a lower part of the connection rod 380, and second ends 364 of links 360 for connecting the arms 240 to the link connection part 390 are pivotally connected to both sides of the link connection part 390. First ends 362 of the links 360 are pivotally coupled to the arms 240 at a position higher than the second ends 364.

Therefore, when a user pushes the arms 240 to approach them toward each other, mechanical coupling structure of the arms 240, the links 360, the link connection part 390 and the connection rod 380 move the head part 372 downward to compress the coil spring 251.

The chest expander in accordance with a fourth exemplary embodiment of the present invention includes an adjustment screw 400 fastened to a lower end of the connection rod 380 and disposed under the link connection part 390 to adjust strength of the chest expander.

The adjustment screw 400 functions to position the link connection part 390 at the connection rod 380. Therefore, when the adjustment screw 400 is rotated in one direction, the link connection part 390 moves upward along the connection rod 380, and a distance between the arms 240 are lengthened. On the other hand, when the adjustment screw 400 is rotated in the other direction, the link connection part 390 moves downward. Therefore, it is possible to adjust strength of the chest expander using the same theory as shown in FIGS. 10 to 12. A relatively weak spring 395 is installed between the link connection part 390 and the lower end of the hollow cylindrical part 222 to support the link connection part 390 and the connection rod 380 connected thereto.

The embodiment shown in FIG. 14 is advantageous to obtain an inner space of the coil spring 251 for accommodating an additional coil spring 252 in the coil spring 251.

Meanwhile, referring to FIG. 14, the links 360 have bent parts between the first ends 362 and the second ends 364. An angle $\alpha$ formed by lines extending from the arms 240 is smaller than an angle $\beta$ formed by lines extending from arm connection points B of the first ends 362 to connection points A of the arm connection parts 230 and the arms 240.

As can be seen from the foregoing, a chest expander in accordance with the present invention includes a spring installation part at a head, both sides of which are connected to arms, to provide a resilient force applied by a spring installed in the head using a force added by the arms of the chest expander, thereby simplifying structure of the spring. In addition, since the power is added by the arms through a link connection part that compresses or releases the spring, rather than providing a resilient force to each spring using each arm, uniform distribution of the force to the arms is enabled.

Further, when a coil spring is used as a spring member, it is possible to prevent breakage of a connection part between the coil spring and the arms of the conventional chest expander using a resilient force generated when the coil spring is compressed.

Furthermore, using a gas spring as a spring member, it is possible to uniformly distribute a resilient force through a simple structure of the gas spring.

In addition, since the chest expander employs a structure for converting a force applied to the arms into a vertical movement of the spring installed in the head, it is possible to simplify the structure of the chest expander and adjust strength of the chest expander.

Although a few embodiments of the present invention have been shown and described, it will be appreciated by those skilled in the art that changes may be made in these embodiments without departing from the principles and spirit of the invention, the scope of which is defined in the appended claims and their equivalents.

What is claimed is:

1. A chest expander comprising:

a head having a spring installation part at which a spring is installed and arm connection parts installed at both sides of the spring installation part;

a pair of arms pivotally coupled with the arm connection parts of the head at their upper ends;

a spring member vertically installed at the spring installation part of the head, and converting movement of the pair of arms approached toward each other into a resilient force generated by compressing the spring to vertically transmit the resilient force to the arms;

a pair of links having first ends pivotally connected to each arm and second ends extending between the arms; and a spring operation part having a link connection part pivotally connected to the second ends of the links and compressing the spring member using power added and transmitted to the link connection part through the links by the movement of the arms, wherein the spring member is formed of a compression coil spring, and the spring operation part compresses the coil spring using vertical movement of the link connection part, wherein the spring operation part is configured to adjust the magnitude of a resilient force generated by the coil spring when the arms approach each other, wherein the spring installation part is formed of a hollow cylindrical part having an upper open end, and a lower end of the coil spring is supported by a lower surface of the hollow cylindrical part, wherein the spring operation part includes: (i) a head part for supporting an upper end of the coil spring in a compressible manner and (ii) a connection rod extending downward from a lower end of the head part along the hollow cylindrical part to pass through the lower surface of the hollow cylindrical part, and connected to the link connection part at its lower end, and wherein the second ends of the links connected to the link connection part are disposed lower than the first ends of the links to move the link connection part downward when the arms approach each other so that the head part is moved downward by the connection rod to compress the upper end of the coil spring.

2. The chest expander according to claim 1, wherein the hollow cylindrical part has a plurality of hollow cylindrical sections in communication with each other in parallel, and a plurality of coil springs are installed in the hollow cylindrical sections.

3. The chest expander according to claim 2, wherein a pressing piece is installed between the head part and upper ends of the plurality of coil springs to support the upper ends of the plurality of coil springs.

4. The chest expander according to claim 2, wherein the connection rod comprises an upper rod integrally formed with the head part, and a lower rod threadedly coupled with the upper rod to adjust a coupling distance of the rod, and the head part and the upper rod form an adjustment screw to adjust the coupling distance between the upper and lower rods by rotating the head part and the upper rod.

5. The chest expander according to claim 2, wherein the connection rod extends downward through the link connection part, and further comprises an adjustment screw fastened to the connection rod under the link connection part so that the link connection part moves upward and downward along the connection rod by the adjustment screw.

* * * * *